US009825399B2

(12) United States Patent
Kim et al.

(10) Patent No.: US 9,825,399 B2
(45) Date of Patent: Nov. 21, 2017

(54) MODULE ASSEMBLY AND CONNECTOR AND ELECTRONIC DEVICE

(71) Applicant: LUXROBO, Seoul (KR)

(72) Inventors: Seok Jung Kim, Incheon (KR); Yoon Son, Seoul (KR); Sang Hun Oh, Seoul (KR)

( * ) Notice: Subject to any disclaimer, the term of this patent is extended or adjusted under 35 U.S.C. 154(b) by 0 days.

(21) Appl. No.: 15/146,052

(22) Filed: May 4, 2016

(65) Prior Publication Data

US 2017/0256883 A1 Sep. 7, 2017

(30) Foreign Application Priority Data

Mar. 7, 2016 (KR) ..... 10-2016-0027229

(51) Int. Cl.

| | |
|---|---|
| ***H01R 11/30*** | (2006.01) |
| ***H01R 13/62*** | (2006.01) |
| ***A63H 33/06*** | (2006.01) |
| ***H01R 9/24*** | (2006.01) |
| ***H01R 13/514*** | (2006.01) |

(52) U.S. Cl.

CPC ..... *H01R 13/6205* (2013.01); *A63H 33/06* (2013.01); *H01R 9/2458* (2013.01); *H01R 11/30* (2013.01); *H01R 13/514* (2013.01)

(58) Field of Classification Search

CPC .... H01R 13/6205; H01R 11/30; H01R 31/06; H01R 13/2421; H01R 13/64

USPC ..... 439/38–39, 709

See application file for complete search history.

(56) References Cited

U.S. PATENT DOCUMENTS

| | | | | |
|---|---|---|---|---|
| 8,672,228 | B1 | 3/2014 | Saini | |
| 9,019,718 | B2 * | 4/2015 | Bdeir | H01R 11/30 361/792 |
| 9,516,756 | B2 * | 12/2016 | Huang | H05K 1/144 |
| 9,531,118 | B2 * | 12/2016 | Byrne | H01R 13/2421 |
| 2011/0263177 | A1 | 10/2011 | Lemchen | |
| 2013/0343025 | A1 | 12/2013 | Bdeir | |
| 2015/0251104 | A1 | 9/2015 | Lange et al. | |

FOREIGN PATENT DOCUMENTS

| | | | |
|---|---|---|---|
| CN | 103394200 | A | 11/2013 |
| WO | 2012/035567 | A1 | 3/2012 |

* cited by examiner

*Primary Examiner* — Khiem Nguyen

(57) ABSTRACT

Provided are a module assembly, a connector, and an electronic device, the module assembly including a first module that includes a pin configured to selectively protrude from a side thereof, a pin installation portion in which the pin is installed to be movable, and a first magnet configured to attract the pin into the pin installation portion, a second module to be coupled to the first module, the second module including a pin receiver configured to receive the pin when the pin protrudes from the first module, and a second magnet configured to attract the pin into the pin receiver, wherein the second magnet is configured to apply, to the pin, a greater magnitude of magnetic force than the first magnet in a case in which a distance between the first module and the second module is less than a preset distance.

14 Claims, 13 Drawing Sheets

MODULE ASSEMBLY AND CONNECTOR AND ELECTRONIC DEVICE

CROSS-REFERENCE TO RELATED APPLICATION(S)

This application claims the priority benefit of Korean Patent Application No. 10-2016-0027229 filed on Mar. 7, 2016, in the Korean Intellectual Property Office, the disclosure of which is incorporated herein by reference for all purposes.

BACKGROUND

1. Field

One or more example embodiments relate to a module assembly, a connector, and an electronic device.

2. Description of Related Art

Recently, various module-based designing tools have been suggested for the purpose of education, hobbies, research, and manufacture. Modules included in such designing tools may each perform a predetermined function, and be connected to another to form a module assembly. The modules may be electrically connected to one another to exchange energy, signals, or data. A user may design a module assembly to achieve a predetermined purpose by assembling modules according to a provided manual or in a creative manner.

Such modules are provided in the form of blocks having predetermined three-dimensional shapes, in general, the shapes of rectangular parallelepipeds or regular hexahedra. Connecting structures for maintaining coupling between the modules and transferring electrical signals are being adopted.

In an example, US2013/0343025 A1 discloses modules coupled to each other using a male protrusion and a female indentation to be coupled to each other, magnets to maintain engagement therebetween, and spring probes configured to transfer current.

In another example, US2015/0251104 A1 discloses modules coupled to each other using a male protruding coupling plug and a female coupling recess to be coupled to each other, a male annular protruding bar having protrusions and a female annular groove having undercuts, the annular protruding bar and the annular groove to be coupled to each other, and plug contacts and slip ring contacts for electrical contact.

The aforementioned related arts have issues as follows.

First, a member protruding from one of the modules is provided to couple the modules. The protruding member is exposed to an outside at all times, and thus may be easily damaged by external impact.

Further, a direction in which the modules are coupled to each other is restricted to a direction in which the protruding member of the one module fits in a recess of another module. Thus, the modules necessarily need to be coupled to each other in a predetermined order. If coupled in an incorrect order, the modules need to be reassembled.

Further, a user may experience inconvenience in that a process of arranging the protruding member in the recess is to be performed in advance to precisely couple the modules.

In addition, magnets configured to maintain coupling between the modules are exposed outside the module, and thus may come out or be damaged.

SUMMARY

An aspect provides a module assembly, a connector, and an electronic device that may prevent damage to pins used to couple modules to each other.

Another aspect also provides a module assembly, a connector, and an electronic device that may enable modules to be assembled at regular positions without performing a separate arrangement.

Still another aspect also provides a module assembly, a connector, and an electronic device that may prevent damage to magnets configured to maintain coupling between modules.

Yet another aspect also provides a module assembly, a connector, and an electronic device that may enable modules to be assembled irrespective of a coupling order.

According to an aspect, there is provided a module assembly including a first module that includes a pin configured to selectively protrude from a side thereof, a pin installation portion in which the pin is installed to be movable, and a first magnet configured to attract the pin into the pin installation portion, a second module to be coupled to the first module, the second module including a pin receiver configured to receive the pin when the pin protrudes from the first module, and a second magnet configured to attract the pin into the pin receiver. The second magnet may be configured to apply, to the pin, a greater magnitude of magnetic force than the first magnet in a case in which a distance between the first module and the second module is less than a preset distance.

The first module and the second module may each include a terminal configured to transfer at least one of electric energy, electric signals, and data, and the terminal of the first module may be in contact with the terminal of the second module when the first module is coupled to the second module.

The pin may include a head and a projection protruding from the head, and the pin installation portion may include a head guide configured to provide a space in which the head is movable and to guide a movement of the head, a projection guide configured to provide a space in which the projection is movable and to guide a movement of the projection, and a stopper provided between the head guide and the projection guide to prevent the head from being separated toward an outside of the first module.

The second module may further include a pin, a pin installation portion, and a first magnet on a side thereof on which the pin receiver is formed, and the first module may further include a pin receiver into which the pin of the second module is to be inserted, and a second magnet on a side thereof on which the pin is formed.

The first module may further include a pin, a pin installation portion, and a first magnet, or further include a pin receiver and a second magnet on another side thereof for coupling with another module, and the second module may further include a pin, a pin installation portion, and a second magnet on another side thereof for coupling with another module.

The first module may be one of an electronic device and a connector being connected to an external device via a cable, and the second module may be the other of the electronic device and the connector.

According to another aspect, there is also provided a module assembly including a plurality of modules, wherein the modules may each include a housing having a plurality of sides, at least one pin provided on a side of the housing, and configured to have a first state in which the pin protrudes from the housing and a second state in which the pin is received in the housing, and at least one pin receiver provided on a side of the housing, and configured to receive a pin protruding from another module. One of the modules is to be surface-to-surface coupled to another of the modules. When the one module is surface-to-surface coupled to the other module, a pin of the one module may switch from the second state to the first state to be inserted into a pin receiver of the other module.

When the one module is decoupled from the other module, the pin may switch from the first state to the second state.

The one module and the other module may each include a pin operator configured to switch the pin between the first state and the second state.

The pin operator may include a first magnet provided in the one module and configured to attract the pin formed using a magnetic material into the one module or a magnetic material provided in the one module and configured to be magnetized by the pin formed using a magnet to attract the pin into the one module, and a second magnet provided in the other module and configured to attract the pin toward the pin receiver of the other module.

The module assembly may further include a plate that includes a plurality of protrusions to which the modules are to be coupled, and a fit-coupling portion to be coupled to the projections may be formed on a bottom of each of the modules.

The pin may be configured to protrude in a direction perpendicular to a direction in which the modules fit on the plate.

The housing may include a frame configured to form an appearance and an inner structure of the housing, a substrate disposed inside the frame, a terminal provided on a side of the frame and configured to transfer at least one of electric energy, electric signals, and data, and a conducting wire configured to electrically connect the substrate and the terminal.

A processor may be provided on the substrate, and the modules may each be configured to operate independently.

The housing may be formed in the shape of a rectangular parallelepiped, and the terminal may be formed on each side of the housing.

A pair of pins, a pair of pin receivers, or both the pin and the pin receiver may be disposed on each side of the housing with the terminal as the center.

According to still another aspect, there is also provided a connector to connect an external device and an electronic device, the connector including a frame in which a pin receiver is formed such that a pin selectively protruding from the electronic device is to be inserted into the pin receiver, a magnet installed in the frame and configured to attract the pin into the pin receiver, and a terminal provided on a side of the frame, and to be connected to the electronic device via a conducting wire extending through a cable.

According to yet another aspect, there is also provided an electronic device to be connected to an external device through a connector, the electronic device including a frame, a terminal connected to a substrate provided in the frame via a conducting wire and exposed to an outside, a pin configured to selectively protrude from the frame to fasten the connector, and a first magnet configured to maintain a state in which the pin is received in the frame. The pin may be attracted by a second magnet provided in the connector.

The first magnet may be an electromagnet, the electronic device may further include a controller configured to control an electromagnet operator to selectively supply current to the first magnet, and the controller may be configured to magnetize the first magnet when a terminal of the connector is connected to a terminal of the electronic device.

The controller may be configured to control the electromagnet operator to demagnetize the first magnet in accordance with an instruction input through a user interface.

Additional aspects of example embodiments will be set forth in part in the description which follows and, in part, will be apparent from the description, or may be learned by practice of the disclosure.

According to an example embodiment, a module assembly, a connector, and an electronic device may prevent damage to pins used to couple modules to each other. Further, modules may be assembled at regular positions without performing a separate arrangement. In addition, damage to magnets configured to maintain coupling between modules may be prevented. Moreover, modules may be assembled irrespective of a coupling order.

BRIEF DESCRIPTION OF THE DRAWINGS

These and/or other aspects, features, and advantages of the disclosure will become apparent and more readily appreciated from the following description of example embodiments, taken in conjunction with the accompanying drawings of which.

DETAILED DESCRIPTION

Hereinafter, some example embodiments will be described in detail with reference to the accompanying drawings.

When it is determined detailed description related to a related known function or configuration which may make the purpose of the present disclosure unnecessarily ambiguous in describing the present disclosure, the detailed description will be omitted here.

Further, the ordinal terms such as first, second, and the like may be used herein to describe equal and independent elements, and thus should not be construed as indicating "main/sub" or "master/slave" by that order.

Figure 1:
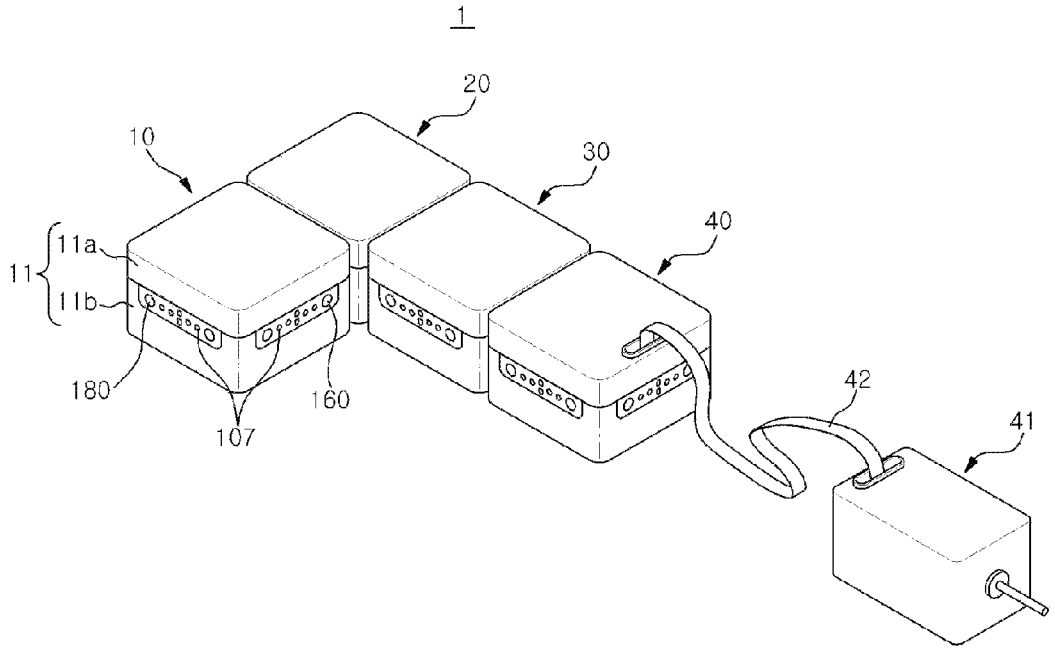
FIG. 1 is a perspective view illustrating a module assembly assembled according to an example embodiment.
Figure 2:
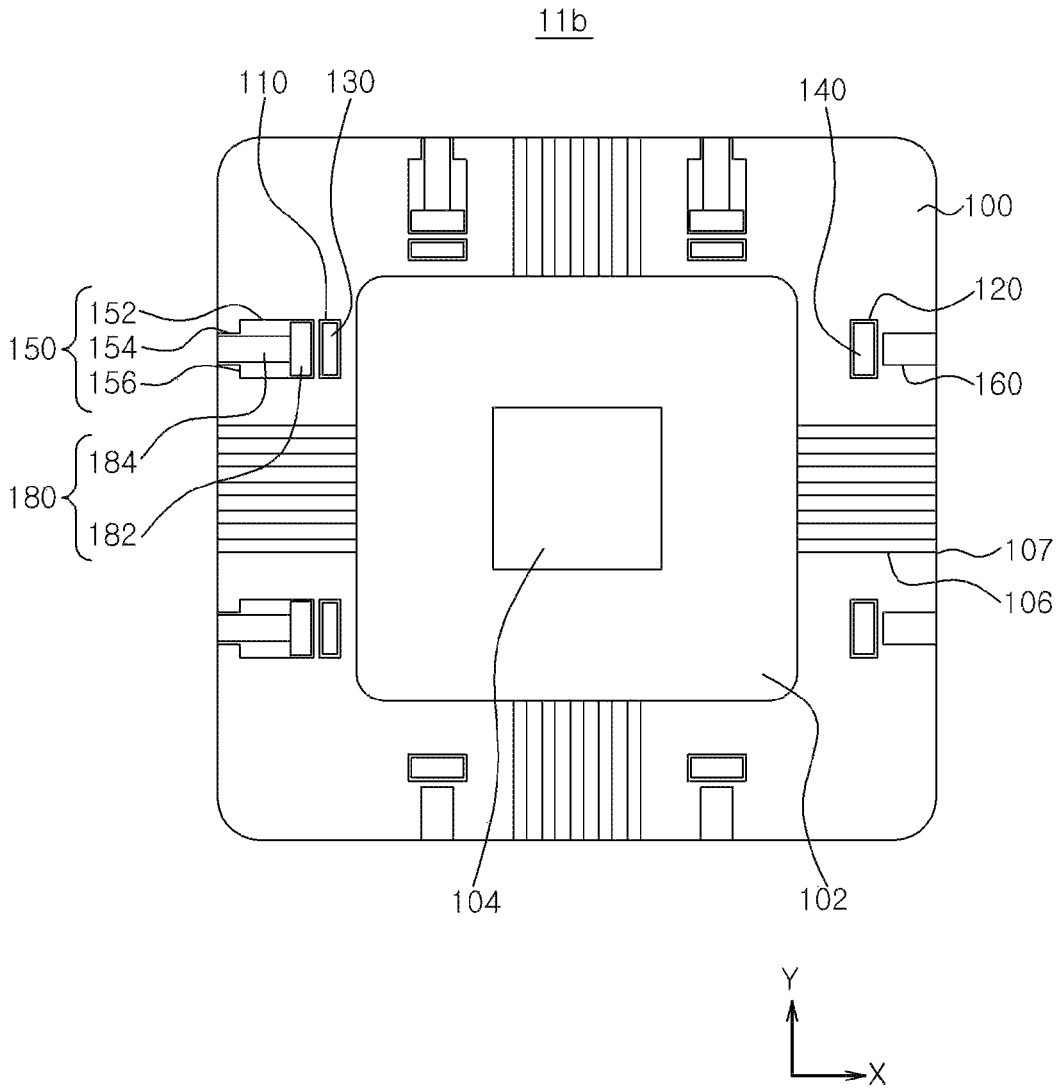
FIG. 2 is a top view illustrating an inner structure of a first module of FIG. 1.

FIG. 1 is a perspective view illustrating a module assembly assembled according to an example embodiment, and FIG. 2 is a top view illustrating an inner structure of a first module of FIG. 1.

Referring to FIGS. 1 and 2, a module assembly 1 according to an example embodiment includes a plurality of modules 10, 20, 30 and 40 to be assembled.

In the example embodiment, the module assembly 1 may be defined as a set of one or more modules 10, 20, 30, and 40 to be assembled or a structure in which the one or more modules 10, 20, 30, and 40 are assembled. However, the purpose, type, form, and number of the modules are not limited thereto. For example, the module assembly 1 may be a part of an educational kit which helps a student or a user to understand an operating principle of an electronic device while assembling the modules 10, 20, 30, and 40. In another example, the module assembly 1 may be a part of a research kit to be used by a researcher to design a device to perform a predetermined purpose. In still another example, the module assembly 1 may be a part of a toy kit to be assembled by a user as a hobby.

In the example embodiment, an example in which the module assembly 1 includes four modules 10, 20, 30, and 40, as shown in FIG. 1, is described. The four modules 10, 20, 30, and 40 may also be referred to as a first module 10, a second module 20, a third module 30, and a fourth module 40, respectively.

In addition, in the example embodiment, the modules 10, 20, 30, and 40 may each be defined as an object configured to exchange at least one of electrical energy, electric signals, and data, hereinafter, referred to only as electric signals, with another module or an external device. The modules 10, 20, 30, and 40 may each include a central processing unit (CPU), a memory, and a power source to operate independently, or may include a sensing device, a processing device, and a driving device to operate by being controlled by another module. Further, the modules 10, 20, 30, and 40 may each be configured to perform a predetermined function independently or by interacting with another module. In a case in which the modules 10, 20, 30, and 40 each include a CPU, firmware may be installed for each module.

For example, in the example embodiment, the first module 10 may be an infrared sensor module configured to receive infrared signals from a remote control. The second module 20 may be a wireless communication module configured to perform wireless communication with a smartphone. The third module 30 may be a gyro sensor module configured to sense a position. The fourth module 40 may be a driving module configured to operate a driving device such as a motor 41. Here, the fourth module 40 may be connected to the driving device via a cable 42. In this example, the module assembly 1 may be a device configured to selectively operate the motor 41 by receiving a signal from the remote control or the smartphone. The foregoing configuration of the module assembly 1 is merely an example. Each module may be provided to perform a predetermined function independently or by interoperating with another module. In addition, in other example embodiments set forth below, the modules 10, 20, 30, and 40 may be construed as independently operable electronic devices such as PCs, laptop computers, smartphones, or tablet PCs, or as connectors to be connected thereto.

The modules 10, 20, 30, and 40 may each be a three-dimensional structure with a circular or polygonal plane having a plurality of sides to be in surface contact with another module. Here, the surface contact may be construed as indicating not only that the whole areas of sides are in contact, but also that sides are partially in contact such that a side of one module is partially in contact with a side of another module while facing each other surface to surface.

In the example embodiment, an example in which the modules 10, 20, 30, and 40 have regular quadrilateral planes of the same size is illustrated. In detail, the modules 10, 20, 30, and 40 each have four sides. In addition, in the example embodiment, an example in which the modules 10, 20, 30, and 40 are the same in heights, and thus the modules 10, 20, 30, and 40 are rectangular parallelepipeds of the same size is described.

In another example embodiment, the modules 10, 20, 30, and 40 may be formed to have polygonal planes such as equilateral triangular planes, rectangular planes, or regular pentagonal planes. A portion of the modules 10, 20, 30, and 40 may have different three-dimensional shapes. Further, a portion of the modules 10, 20, 30, and 40 may have three-dimensional shapes such as pyramidal or prismatic shapes.

Here, the first module 10 may include a housing 11 which forms an appearance of the first module 10 and has a plurality of sides, a terminal 107 exposed on a side of the housing 11 and configured to transfer or receive electric signals to or from another module being connected thereto, a pin installation portion 150 in which a pin 180 configured to selectively protrude externally from the housing 11 is provided, and a pin receiver 160 into which a pin of the other module is to be inserted.

In the example embodiment, the housing 11 is a case formed in the shape of a rectangular parallelepiped with a regular quadrilateral plane, and configured to protect internal components. In an example, as shown in FIG. 1, the housing 11 may be provided in the form in which an upper case 11*a* and a lower case 11*b* are coupled. The housing 11 may be configured by forming the upper case 11*a* and the lower case 11*b* as an integral body, as necessary. In another example, the housing 11 may be divided into a larger number of parts and assembled, or divided in another direction and assembled.

The terminal 107 may transfer or receive electric signals to or from another module being connected thereto. In an example, the terminal 107 may receive electric signals from a substrate 102 provided in the housing 11 and transfer the electric signals to a terminal of the other module being in contact with the terminal 107. The terminal 107 may have a plurality of contact points or connecting pins. The form of the terminal 107 may vary depending on methods of transferring electric signals or standardized standards.

The terminal 107 may be disposed on one side of the housing 11 while forming a set with the pin 180 and the pin installation portion 150, or may be disposed on one side of the housing 11 while forming a set with the pin receiver 160.

In detail, a pair of pins 180, a pair of pin installation portions 150, and a terminal 107 disposed between the pair of pins 180 may be provided on one side of the housing 11. The terminal 107 disposed between the pair of pins 180 may be in contact with a terminal disposed between a pair of pin receivers of another module. In addition, a pair of pin receivers 160, and a terminal 107 disposed between the pair of pin receivers 160 may be provided on another side of the housing 11. The terminal 107 disposed between the pair of pin receivers 160 may be in contact with a terminal disposed between a pair of pins of still another module.

In the example embodiment, an example in which the pin 180 and the pin installation portion 150 are provided on one of two facing sides of the housing 11, and the pin receiver 160 is provided on the other of the two facing sides of the housing 11 will be described. However, such disposition of the pin 180, the pin installation portion 150, and the pin receiver 160 is merely an example. The disposition may be modified by those skilled in the art, as necessary. For example, the pin 180 and the pin installation portion 150, or the pin receiver 160 may be provided on each of the two facing sides of the housing 11. In another example, the pin 180 and the pin installation portion 150 may be provided on each of three sides of the housing 11 and the pin receiver 160 may be provided on the other side of the housing 11, and vice versa. In still another example, the pin 180 and the pin installation portion 150, or the pin receiver 160 may be provided on each of the four sides of the housing 11.

Further, in the example embodiment, an example in which a pair of pins 180 and a pair of pin installation portions 150 are provided on one side of the housing 11, or an example in which a pair of pin receivers 160 are provided on one side of the housing 11 is described. However, one or at least three pins 180, pin installation portions 150, and pin receivers 160 may be provided on one side of the housing 11 as necessary. The number of the pins 180, the number of the pin installation portions 150, and the number of the pin receivers 160 may vary for each side. In another example, nothing may be provided on one side of the housing 11.

In another example embodiment, only the terminal 107, only a pair of pins 180 and a pair of pin installation portions 150, or only a pair of pin receivers 160 may be provided on one side of the housing 11.

In still another example embodiment, all of the pin 180, the pin installation portion 150, and the pin receiver 160 may be provided on one side of the housing 11.

In yet another example embodiment, only one of the pin 180 and the pin receiver 160 may be provided in each side of the first module 10, and the other of the pin 180 and the pin receiver 160 may be provided in another module.

Referring to FIG. 2, the lower case 11*b* may include a frame 100 which forms an appearance and an inner structure of the first module 10, the substrate 102 provided in the frame 100, and a processor 104 installed on the substrate 102.

The frame 100 may be a structure which forms a portion or the whole of the housing 11. The frame 100 may form an appearance of a portion or the whole of the housing 11, and provide a structure and a space to install a variety of components therein. In the example embodiment, an example in which the frame 100 forms the lower case 11*b* of the housing 11 is described. However, the scope of example embodiments is not limited thereto.

Electronic components (not shown) to implement a function of the first module 10 may be mounted on the substrate 102. The substrate 102 may be fastened at a center of an inner space of the frame 100. As described above, in a case in which the first module 10 is an infrared sensor module, an infrared sensor may be provided on one side of the housing 11, and the substrate 102 may be electrically connected to the infrared sensor.

The processor 104 may be provided to control the first module 10 in a case in which the first module 10 is driven by independent firmware. The processor 104 may be omitted depending on a function or a characteristic of the first module 10. As described above, in a case in which the first module 10 is an infrared sensor module, the processor 104 may process a value sensed by the infrared sensor and transfer a resulting value to another module.

Meanwhile, the terminal 107, the pin 180, the pin installation portion 150, and the pin receiver 160 may be provided on a side of the frame 100. A first magnet 130 may be provided on one side of the pin installation portion 150, and a second magnet 140 may be provided on one side of the pin receiver 160.

In detail, the terminal 107 may function as a path to exchange electric signals with another module, and may correspond to an end portion of a conducting wire 106 which extends from the substrate 102. Here, the terminal 107 may be a metallic plate or a spring probe which is elastically movable and displaceable to some extent, and the conducting wire 106 may be connected thereto. The terminal 107 may transfer electric signals provided from the substrate 102 to another module, or receive electric signals from another module and transfer the electric signals to the substrate 102. In an example, the terminal 107 may be configured to transfer electric signals directly to a terminal 107 disposed on another side.

In the example embodiment, an example in which terminals 107 are formed at centers of four sides of the frame 100 will be described. In this example, terminals are formed at centers of sides of all modules, and thus the modules may be easily assembled. Further, an example in which a plurality of terminals 107 and conducting wires 106 are provided on sides of the frame 100 is illustrated. However, the number of the terminals 107 and the number of the conducting wires 106 may vary as necessary.

The pin 180 and the pin installation portion 150 may be provided on one side of the frame 100. In the example embodiment, an example in which a pair of pins 180 and a pair of pin installation portions 150 are provided on one side of the housing 11 at positions a predetermined distance spaced apart from the terminal 107 in an X-axial or Y-axial direction will be described. Further, the pin receiver 160 may be provided on another side of the frame 100. In the example embodiment, an example in which a pair of pin receivers 160 are provided on one side of the housing 11 at positions a predetermined distance spaced apart from the terminal 107 in an X-axial or Y-axial direction will be described.

In the example embodiment, as shown in FIG. 2, the pin receiver 160 may be formed on a side facing a side on which the pin 180 and the pin installation portion 150 are formed. An example in which the pin receivers 160 are provided on two sides of the housing 11, and the pins 180 and the pin installation portions 150 are provided on the other two sides of the housing 11 will be described.

In this example, the positions of the pin receivers 160 in the X-axial or Y-axial direction may correspond to positions of pins of another module to be connected to the first module 10. In a case in which modules are formed in the same shapes as described in the example embodiment, the pin receivers 160 may be disposed at positions corresponding to positions of the pins 180 provided on another side of the housing 11. In detail, in FIG. 2, the positions of the pins 180 in the X-axial or Y-axial direction may correspond to the positions of the pin receivers 160 in the X-axial or Y-axial direction. Thus, when coupling modules, pins of another module having the same shape may be inserted into the pin receivers 160.

The pin 180 may be a magnetic material, and may include a head 182 and a projection 184 protruding from the head 182. In an example, the pin 180 may be metal including an iron (Fe) component. The head 182 may have a cross-sectional area larger than that of the projection 184. In an example, the pin 180 may be "T"-shaped. In this example, a portion of the head 185 may be obstructed by a stopper 156 of the pin installation portion 150. Thus, when the pin 180 is attracted toward an adjacent module by magnetic force, the entire first module 10 may be moved, whereby the modules may be automatically coupled to each other.

The pin 180 may be installed in the pin installation portion 150 to be movable in an outward direction or an inward direction of the housing 11. In detail, the first module 10 may have a first state in which the pin 180 is protruding from the first module 10, and a second state in which the pin 180 is received in the first module 10. To achieve the foregoing, the pin installation portion 150 may include a head guide 152 configured to provide a space in which the head 182 of the pin 180 is movable and to guide a movement of the head 182, a projection guide 154 configured to provide a space in which the projection 184 of the pin 180 is movable and to guide a movement of the projection 184, and the stopper 156 provided between the head guide 152 and the projection guide 154 to prevent the head 182 from being separated toward an outside of the frame 100. In the example embodiment, an example in which the pin installation portion 150 includes the head guide 152 and the projection guide 154 is described. However, the configuration of the pin installation portion 150 may vary depending on the shape of the pin 180.

The head guide 152 and the projection guide 154 may be formed in shapes and sizes corresponding to cross-sectional areas of the head 182 and the projection 184 such that the pin 180 may slide stably. One side of the projection guide 154 may be opened toward the outside of the frame 100 such that the projection 184 may protrude toward the outside of the frame 100 as the pin 180 moves. In the example embodiment, an example in which the pin installation portion 150 is configured such that the pin 180 may protrude in a direction perpendicular to a side of the frame 100 is illustrated. However, the pin installation portion 150 may be configured such that the protruding direction of the pin 180 and the side of the frame 100 may form a predetermined angle.

The first magnet 130 may be provided on one side of the pin installation portion 150 to apply magnetic force to the pin 180 such that the pin 180 may be maintained in the second state, in detail, a state in which the pin 180 does not protrude from the housing 11 while the first module 10 is not coupled to another module. The first magnet 130 may be installed at a predetermined position at which the first magnet 130 may provide magnetic force to the pin 180 such that the pin 180 may be maintained in the pin installation portion 150.

When the first magnet 130 is provided on one side of the pin 180, the pin 180 may be magnetized. For example, in a case in which a side of the first magnet 130 faces the pin 180 and the side corresponds to north pole (N-pole), the head 182 may be magnetized as south pole (S-pole) and an end portion of the projection 184 may be magnetized as N-pole. Thus, the pin 180 may function as a magnet. When magnetic force of a second magnet provided in another module is not applied, the pin 180 may be attracted toward the first magnet 130 and received in the housing 11. When magnetic force of the second magnet provided in the other module is applied, the pin 180 may protrude toward the outside of the housing 11.

In the example embodiment, an example in which the first magnet 130 is disposed adjacent to the head guide 152, in detail, between the pin installation portion 150 and the substrate 102 will be described. In this example, the first magnet 130 may apply magnetic force to the entire head 182 having a relatively large area, and thus the size of the first magnet 130 may be minimized.

In addition, a first magnet installation portion 110 configured to receive the first magnet 130 is provided in the frame 100. The first magnet installation portion 110 may be provided to fix a position of the first magnet 130. The first magnet installation portion 110 may be provided in the frame 100 to be recessed in a form of a recess. The first magnet installation portion 110 may be formed to be a predetermined distance spaced apart from the pin installation portion 150, or to be in contact with the pin installation portion 150. Further, the first magnet installation portion 110 may be provided such that the first magnet 130 may not be exposed outside the first module 10. However, the foregoing is merely an example, and the scope of example embodiments is not limited thereto. For example, the first magnet installation portion 110 may be connected with the pin installation portion 150 to form a single communicating space. The first magnet installation portion 110 may include a structure such as a stopper to maintain the position of the first magnet 130.

The pin receiver 160 may provide a space to receive a pin protruding from another module. The pin receiver 160 may be formed in the shape of a recess having a width and a depth corresponding to those of a projection of the pin protruding toward an outside of the other module.

The second magnet 140 is provided on one side of the pin receiver 160, and configured to apply magnetic force to a pin of another module, thereby attracting the pin of the other module into the pin receiver 160. In detail, the second magnet 140 may maintain the pin of the other module to be in the first state. To achieve the foregoing, the second magnet 140 may be provided to have magnetism to apply stronger magnetic force to the pin of the other module than a first magnet of the other module may do when the pin of the other module is within a set distance, hereinafter, a "valid distance", from the second magnet 140. The valid distance may vary depending on a magnitude of the magnetic force of the first magnet and a magnitude of the magnetic force of the second magnet, the first magnet and the second magnet being included in each module. The valid distance increases as the magnitude of the magnetic force of the second magnet increases.

The second magnet 140 may be installed at a predetermined position at which the second magnet 140 may attract a pin of another module into the pin receiver 160.

In an example, the second magnet 140 may be formed such that a polarity opposite to a polarity of a magnetized projection of a pin of another module may be disposed toward the pin receiver 160. For example, in a case in which an end portion of the projection of the pin of the other module is magnetized as N-pole, S-pole of the second magnet 140 may be disposed toward the pin receiver 160. In this example, when the first module 10 gets close to the other module, the pin of the other module may be attracted by attractive force applied by the second magnet 140 and fit in the pin receiver 160.

Further, the second magnet 140 may be formed such that a polarity the same as a polarity of a magnetized projection of a pin of another module may be disposed toward the pin receiver 160. For example, in a case in which an end portion of the projection of the pin of the other module is magnetized as N-pole, N-pole of the second magnet 140 may be disposed toward the pin receiver 160. In this example, N-pole of a first magnet of the other module may be disposed toward a pin of the other module. When the first module 10 gets close to the other module, the pin of the other module may receive repulsive force from the second magnet 140 at first. When a distance between the pin of the other module and the second magnet 140 is less than a predetermined distance, the second magnet 140 may apply stronger magnetic force to the pin of the other module than a first magnet of the other module may do. Thus, the polarity of the pin of the other module may switch such that the polarity of the end portion of the projection may change to S-pole and the polarity of the head may change to N-pole. Then, the pin of the other module may receive attractive force from the second magnet 140 and receive repulsive force from the first magnet of the other module, thereby protruding more definitely.

In the example embodiment, an example in which the second magnet 140 is disposed adjacent to the pin receiver 160, in detail, between the pin receiver 160 and the substrate 102 will be described. In this example, the pin of the other module may be attracted to an innermost side of the pin receiver 160. Thus, the first state in which the pin of the other module protrudes may be maintained stably.

A second magnet installation portion 120 configured to receive the second magnet 140 is provided in the frame 100. The second magnet installation portion 120 may be provided to fix a position of the second magnet 140. The second magnet installation portion 120 may be provided in the frame 100 to be recessed in a form of a recess. The second magnet installation portion 120 may be formed to be a predetermined distance spaced apart from the pin receiver 160, or to be in contact with the pin receiver 160. Further, the second magnet installation portion 120 may be provided such that the second magnet 140 may not be exposed outside the first module 10. However, the foregoing is merely an example, and the scope of example embodiments is not limited thereto. For example, the second magnet installation portion 120 may be connected with the pin receiver 160 to form a single communicating space. The second magnet installation portion 120 may include a structure such as a stopper to maintain the position of the second magnet 140.

Here, the first magnet 130 and the second magnet 140 of the other module, or the second magnet 140 and the first magnet 130 of the other module may maintain the pin 180 or the pin of the other module to be in the first state or the second state, and thus may also be referred to as a pin operator.

In addition, in the example embodiment, the first magnet 130 and the second magnet 140 may be permanent magnets or electromagnets. In a case in which the first magnet 130 and the second magnet 140 are electromagnets, a power supplier such as a battery may be provided in the first module 10 to supply current to each of the electromagnets. In another example, the first magnet 130 and the second magnet 140 being electromagnets may be provided to operate by receiving current from another module when the terminal 107 is connected to a terminal of the other module.

In the example embodiment, an example in which all of the aforementioned components are received in the lower case 11*b* is described. However, the foregoing is merely an example, and the scope of example embodiments is not limited thereto. For example, the pin installation portion 150, the pin receiver 160, the first magnet installation portion 110, and the second magnet installation portion 120 may have complete forms when the upper case 11*a* is coupled to the lower case 11*b*. The pin 180, the first magnet 130, and the second magnet 140 may be disposed in both the upper case 11*a* and the lower case 11*b*. In another example, a portion or all of the aforementioned components may be installed in the upper case 11*a*.

Meanwhile, the other modules, in detail, the second module 20, the third module 30, and the fourth module 40 may be the same or correspond to the first module 10 in terms of structural characteristics. For example, in a case in which the first module 10 has a structure as shown in FIGS. 1 and 2, the remaining modules 20, 30, and 40 may have the same structures. Hereinafter, an example in which the second module 20, the third module 30, and the fourth module 40 have configurations substantially the same as that of the first module 10 in terms of a coupling manner will be described. In this example, all the modules may be formed to have the same appearances. Thus, an overall process of manufacturing the module assembly 1 may be simplified, and the modules may be easily assembled.

Hereinafter, to prevent duplicated descriptions, detailed descriptions of components of the second module 20, the third module 30, and the fourth module 40 corresponding to the components of the first module 10 will be omitted. If necessary, descriptions will be provided by changing the first digits of the reference numerals thereof to "2", "3", and "4", respectively. For example, a pin of the second module 20 corresponding to the pin 180 of the first module 10 may be assigned a reference numeral 280. In detail, the second module 20 may include a frame 200, a substrate 202, a processor 204, a conducting wire 206, a terminal 207, the pin 280, a pin installation portion 250, a pin receiver 260, a first magnet installation portion 210, a first magnet 230, a second magnet installation portion 220, and a second magnet 240.

Hereinafter, a process of coupling the first module 10 and the second module 20 will be described with reference to the drawings.

Figure 3:
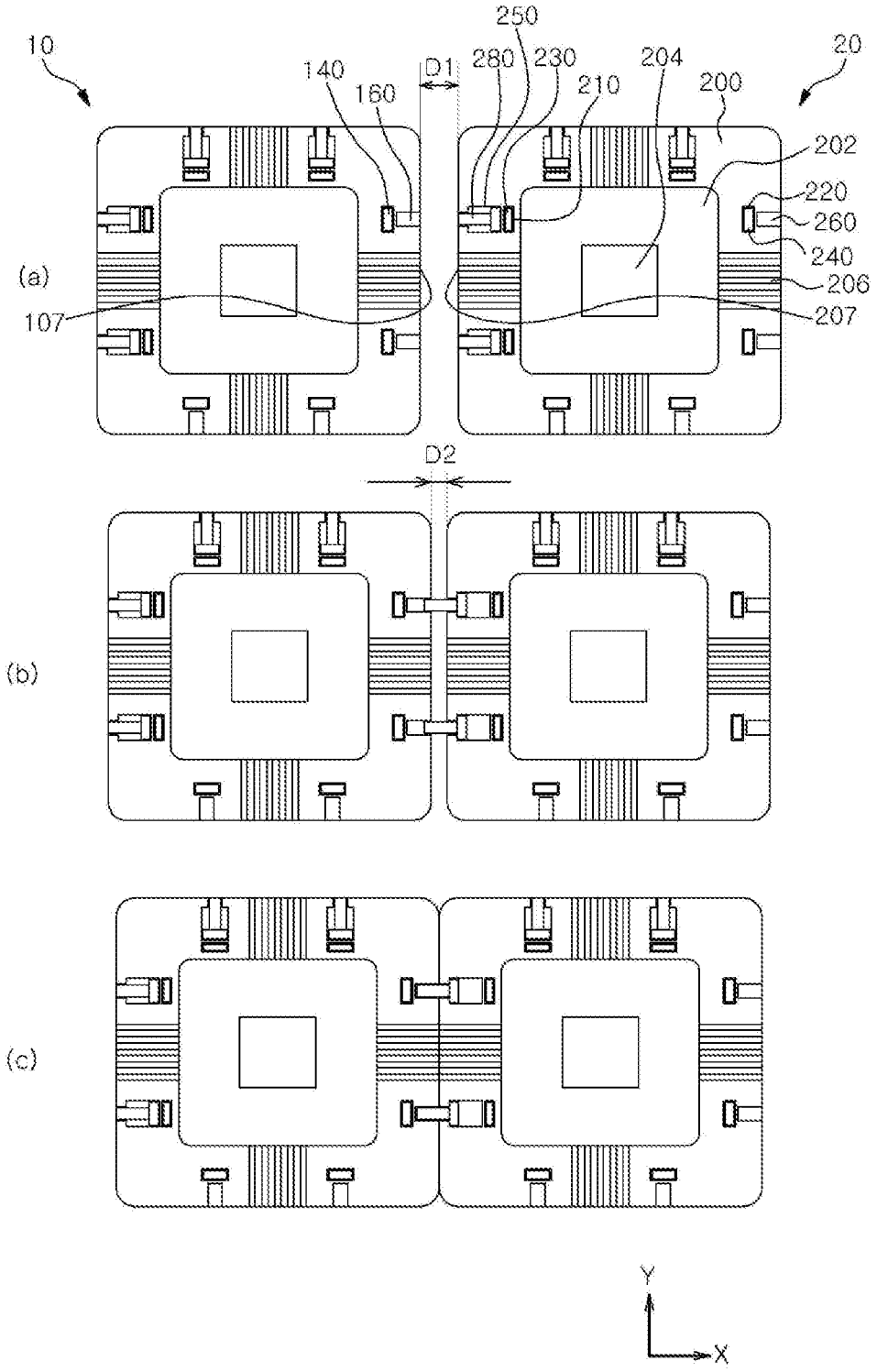
FIG. 3 illustrates a process of coupling the first module and a second module of FIG. 1.

FIG. 3 illustrates a process of coupling the first module and the second module of FIG. 1.

Referring to (a) of FIG. 3, a side of the first module 10 on which the pin receiver 160 is provided may be disposed toward the second module 20, and a side of the second module 20 on which the pin 280 is provided may be disposed toward the first module 10, whereby the first module 10 and the second module 20 may be coupled to each other in an X-axial direction. In a case in which the pin receiver 160 and the pin 280 are disposed reversely, or the first module 10 and the second module 20 are disposed alongside in a Y-axial direction, the first module 10 and the second module 20 may also be coupled to each other. Here, an example in which the first module 10 and the second module 20 are aligned in the Y-axial direction will be described.

In a case in which a distance between the first module 10 and the second module 20 is greater than or equal to a predetermined distance D1, and a distance between the pin 280 of the second module 20 and the second magnet 140 of the first module 10 is greater than the valid distance, a magnitude of magnetic force applied by the second magnet 140 of the first module 10 to the pin 280 of the second module 20 may be less than or equal to a magnitude of magnetic force applied by the first magnet 230 of the second module 20 to the pin 280 of the second module 20. In this example, the pin 280 of the second module 20 may be maintained to be in the second state in which the pin 280 is received in the second module 20.

Referring to (b) of FIG. 3, in a case in which the distance between the first module 10 and the second module 20 decreases to D2, and the distance between the pin 280 of the second module 20 and the second magnet 140 of the first module 10 is less than the valid distance, the magnitude of the magnetic force applied by the second magnet 140 of the first module 10 to the pin 280 of the second module 20 may be greater than the magnitude of the magnetic force applied by the first magnet 230 of the second module 20 to the pin 280 of the second module 20. Thus, the pin 280 of the second module 20 may be moved toward the second magnet 140 of the first module 10 and protrude outside the second module 20. The protruding pin 280 of the second module 20 may be inserted into the pin receiver 160 of the first module 10.

Here, the magnetic force generated from the second magnet 140 of the first module 10 may be applied directly to the pin 280 exposed at a side end portion of the second module 20, thereby more easily attracting the pin 280.

In this example, a head of the pin 280 of the second module 20 may be hung on a stopper of the pin installation portion 250, and the pin 280 may be attracted toward the second magnet 140 of the first module 10, whereby the frame 200 of the second module 20, in detail, the entire second module 20 may be moved toward the first module 10.

As the pin 280 of the second module 20 gradually protrudes from the second module 20, the magnitude of the magnetic force applied from the second magnet 140 of the first module 10 may gradually increase, and the magnitude of the magnetic force applied from the first magnet 230 of the second module 20 may gradually decrease. Thus, a speed at which the first module 10 approaches the second module 20 may be accelerated.

The lower drawing (c) of FIG. 3 illustrates a complete coupling state between the first module 10 and the second module 20. In this example, the first module 10 and the second module 20 may be in surface contact with each other. The pin 280 of the second module 20 may be in the first state in which the pin 280 protrudes to an outside, and a projection of the pin 280 may be inserted into the pin receiver 160 of the first module 10. In this example, the terminal 107 of the first module 10 and the terminal 207 of the second module 20 may be in contact with each other, thereby exchanging electric signals with each other.

The coupling state between the first module 10 and the second module 20, in detail, the coupling state in an X-axial direction may be firmly maintained by magnetic force. In addition, the coupling states between the first module 10 and the second module 20 in a Y-axial direction and a Z-axial direction, for example, a direction vertical to the ground, may be firmly maintained by the pin 280 of the second module 20.

In the same manner, the third module 30 and the fourth module 40 may also be coupled to the first module 10 or the second module 20.

Meanwhile, a separation between the first module 10 and the second module 20 may be performed in a reverse order of the foregoing process. When a user decouples the second module 20 from the first module 10 such that a distance between the two modules is greater than the preset distance D1, the magnitude of the magnetic force applied by the second magnet 140 of the first module 10 to the pin 280 of the second module 20 may be less than the magnitude of the magnetic force applied by the first magnet 230 of the second module 20 to the pin 280 of the second module 20. Thus, the pin 280 may be moved back toward the first magnet 230 of the second module 20, and be in the second state in which the pin 280 is received in the second module 20.

Figure 4:
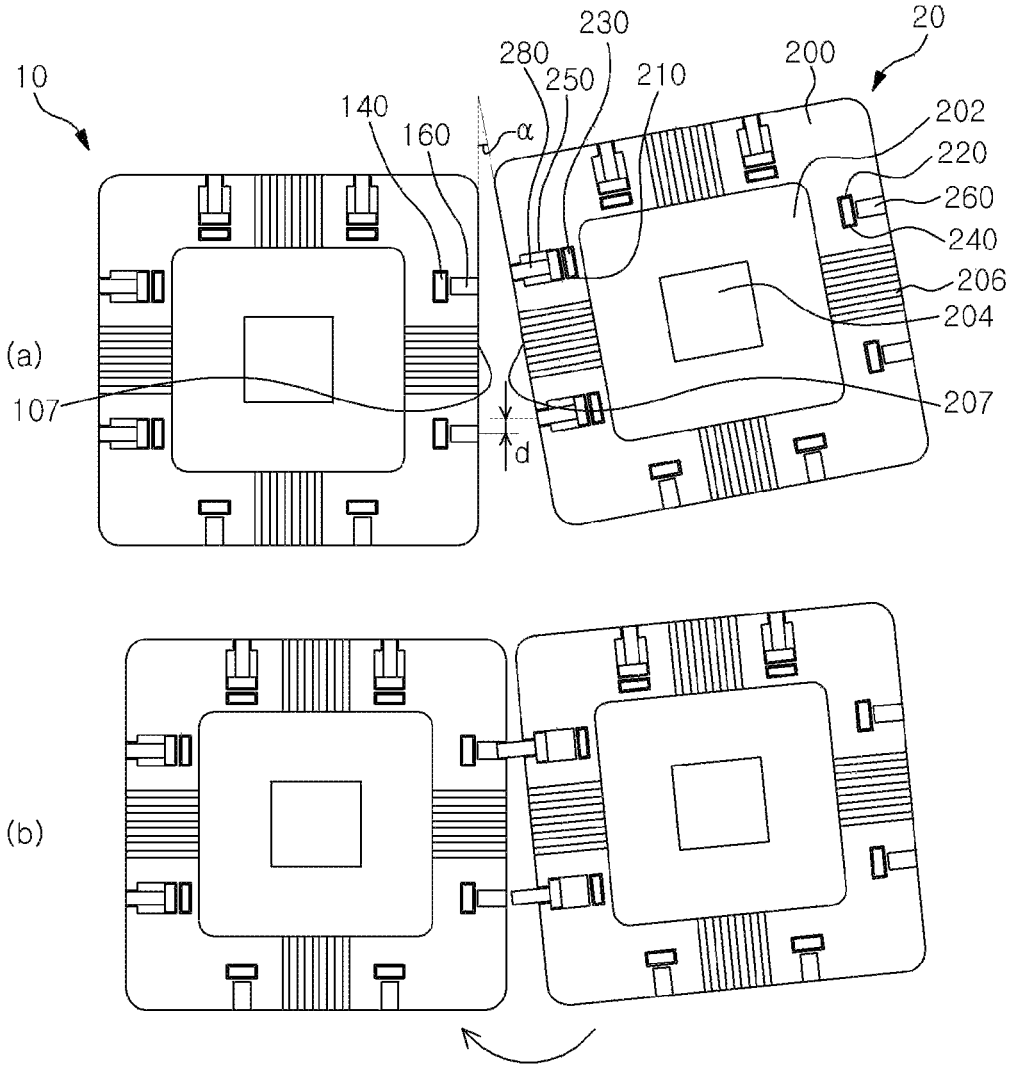
FIG. 4 illustrates a process of coupling the first module and the second module of FIG. 1 in a misaligned state.

FIG. 4 illustrates a process of coupling the first module and the second module of FIG. 1 in a misaligned state.

Referring to (a) of FIG. 4, the first module 10 and the second module 20 are disposed to tilt with respect to each other at an angle of a degrees based on a Y axis or are a distance of d spaced apart from each other in a Y-axial direction. Even in the misaligned state, the first module 10 and the second module 20 may be smoothly coupled to each other.

In detail, although the first module 10 and the second module 20 are misaligned, the pin 280 of the second module 20 may be attracted toward the second magnet 140 of the first module 10 when the first module 10 and the second module 20 are positions such that the distance between the pin 280 of the second module 20 and the second magnet 140 of the first module 10 is less than the valid distance.

In this example, since a magnitude of magnetic force of a magnet is maximized at a center of the magnet, the pin 280 of the second module 20 may be attracted toward the center of the second magnet 140 of the first module 10, in detail, substantially toward the pin receiver 160 of the first module 10.

A magnitude of magnetic force applied by the second magnet 140 of the first module 10 may increase as the distance between the two modules 10 and 20 decreases. As shown in (b) of FIG. 4, a projection of the pin 280 of the second module 20 may fit in the pin receiver 160 of the first module 10. Accordingly, another pin 280 provided on the same side of the second module 20 may be induced toward another pin receiver 160 of the first module 10, and ultimately fit in the other pin receiver 160 of the first module 10. In this process, the pin 280 of the second module 20 first induced toward the first module 10 may act as a center of rotation of the second module 20, or may slide along the side of the first module 10. To achieve the foregoing operation smoothly, the projection of the pin 280 of the second module 20 may have a rounded end portion.

Figure 5:
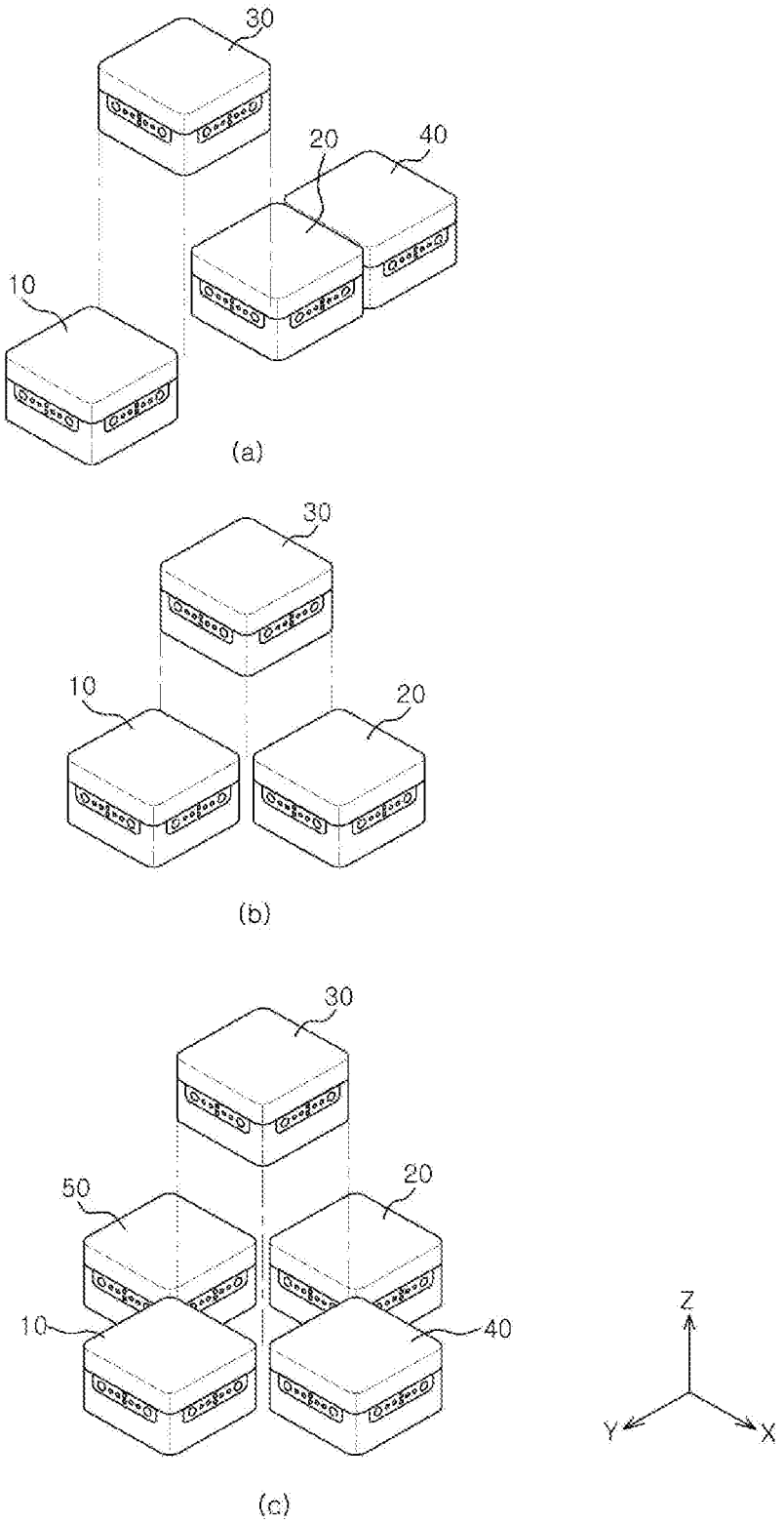
FIG. 5 illustrates a process of coupling at least three modules in a module assembly according to an example embodiment.

FIG. 5 illustrates a process of coupling at least three modules in a module assembly according to an example embodiment.

In the related arts, a coupling protrusion protrudes outside a module at all times. Thus, in situations as shown in (a) and (b) of FIG. 5, the third module 30 may not be coupled to the first module 10 and the second module 20. The third module 30 may need to be coupled to the first module 10 or the second module 20 first, and other modules may be sequentially coupled thereto. Further, in a situation as shown in (c) of FIG. 5, to couple the third module 30, other modules 10, 20, 40, and 50 may need to be separated from each other, and coupled to the third module 30 one at a time.

In contrast, one module 30 according to an example embodiment may be assembled with other modules irrespective of a coupling order. Further, one module 30 may be assembled in a direction in which a pin of the one module 30 is inserted into a pin receiver of another module, in detail, an X-axial or Y-axial direction, and also in a direction perpendicular thereto, for example, a Z-axial direction. In addition, one module 30 may be assembled into a space between two modules 10 and 20 being spaced apart from each other, irrespective of a direction.

First, as shown in (a) of FIG. 5, the third module 30 may be assembled in a state in which the second module 20 and the fourth module 40 are already assembled, and the first module 10 is spaced apart from the second module 20. In detail, in a case in which the modules are to be arranged in an "I"-shaped form, a module assembly may be assembled by adding a new module between the modules. In this example, the third module 30 may be coupled to the first module 10 and the second module 20 simultaneously.

In detail, the third module 30 may fit in the space between the first module 10 and the second module 20 while being in surface contact with the first module 10 and the second module 20 simultaneously. In the drawing, an example in which the third module 30 fits in the space in the Z-axial direction is provided. However, the third module 30 may also fit in the X-axial or Y-axial direction. When the third module 30 is disposed at a regular position, pins may protrude from one of the first module 10 and the second module 20 and be inserted into the third module 30, and pins may protrude from the third module 30 and be inserted into the other of the first module 10 and the second module 20. In doing so, the third module 30 may be firmly fastened to the first module 10 and the second module 20.

Further, as shown in (b) of FIG. 5, the third module 30 may be assembled with the first module 10 and the second module 20 simultaneously in a state in which the first module 10 and the second module 20 are disposed in a diagonal direction. Similar to the case of (a) of FIG. 5, the third module 30 may enter the space between the first module 10 and the second module in a predetermined direction, and be coupled to the first module 10 and the second module 20 simultaneously while being in surface contact therewith. In detail, in a case in which modules are to be arranged in an "L"-shaped form, a module assembly may be assembled by adding a new module at an intermediate position therebetween.

In addition, as shown in (c) of FIG. 5, the third module 30 may be assembled by fitting in a space surrounded by the other modules 10, 20, 40, and 50. In this example, the third module 30 may fit in the space among the modules 10, 20, 40, and 50 in the Z-axial direction. In an example, when the third module 30 fits in to be disposed at a regular position, pins may protrude from the first module 10 and the fourth module 40 and be inserted into the third module 30, and pins may protrude from the third module 30 and be inserted into the second module 20 and the fifth module 50. In detail, in a case in which modules are to be arranged in a cross-shaped form, a model assembly may be assembled by adding a new module at an intermediate position thereamong.

Hereinafter, effects of the module assembly 1 according to an example embodiment will be described based on a coupling relationship between the first module 10 and the second module 20.

The module assembly 1 as described above may have effects as follows.

A user may assemble the modules 10, 20, 30, and 40 simply by disposing the modules 10, 20, 30, and 40 within a preset distance, thereby assembling the module assembly 1 conveniently.

Further, the first module 10 and the second module 20 may have a first state in which the pins 180 and 280 protrude from the modules 10 and 20, and a second state in which the pins 180 and 280 are received in the modules 10 and 20, respectively. The pins 180 and 280 may be in the second state in which the pins 180 and 280 are received in the modules 10 and 20 in a case in which the modules 10 and 20 are not coupled to each other, and in a case in which a distance between the modules 10 and 20 is greater than a preset distance such that the modules 10 and 20 do not attract each other through interaction between the first magnet 130 and the second magnet 140 and interaction between the first magnet 230 and the second magnet 240, respectively. Thus, the pins may not be damaged by impact applied while the modules are not assembled.

In addition, the first module 10 and the second module 20 may be easily coupled to each other in a state in which the pins 180 and 280 are not completely aligned with the pin receivers 160 and 260. Magnetic forces applied by the second magnets 140 and 240 to outsides of the modules 10 and 20 through the pin receivers 160 and 260 may be applied directly to the pins 180 and 280 exposed to side end portions of the modules 10 and 20. Thus, the pins 180 and 280 may be easily attracted, and naturally induced into the pin receivers 160 and 260 by the magnetic forces, whereby the first module 10 and the second module 20 may be automatically aligned and coupled to each other.

Further, all the magnets 130, 140, 230, and 240 provided in the modules 10 and 20 may be disposed in the frames 100 and 200, and may not be exposed to an outside. Thus, the magnets 130, 140, 230, and 240 may not be damaged by external impact or friction.

In addition, one module 30 may be coupled to the other modules irrespective of a coupling order and a coupling direction. The foregoing effect may be achieved in the manner in which pins provided in a module are maintained in the first state while being unassembled and protrude to be in the second state only when modules are in surface contact with each other. In particular, in a case in which the modules are formed in the shapes, the assembly convenience of the modules may be maximized.

Further, the module assembly 1 may be assembled in a simple structure by means of the magnets and the pins provided in the modules 10, 20, 30, and 40, and thus the sizes of the modules 10, 20, 30, and 40 may be minimized.

Hereinafter, a module assembly according to another example embodiment will be described with reference to FIG. 6. However, the example embodiment of FIG. 6 differs from the example embodiment of FIG. 2 in terms of pins and a configuration that maintains the pins in the second state. Thus, the example embodiment of FIG. 6 will be described based on such differences, and the same descriptions and reference numerals of FIG. 2 will be applied to the same components.

Figure 6:
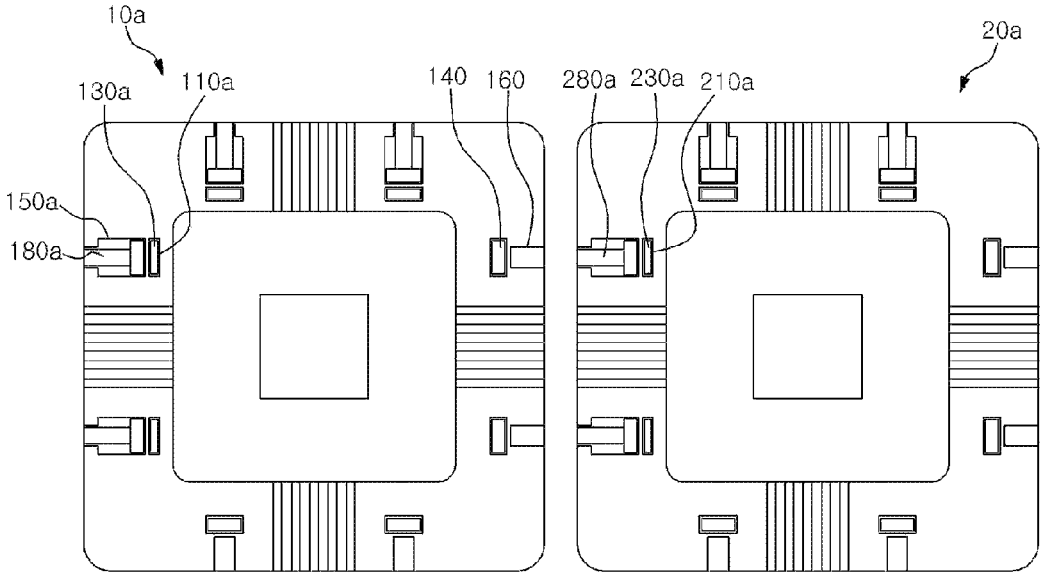
FIG. 6 illustrates a process of coupling a first module and a second module in a module assembly according to another example embodiment.

FIG. 6 illustrates a process of coupling a first module and a second module in a module assembly according to another example embodiment.

Referring to FIG. 6, a pin 180*a* of a first module 10*a* of a module assembly according to another example embodiment may be formed using a magnet. The pin 180*a* may have a corresponding polarity and thus, may be attracted by a second magnet of another module. A magnetic material 130*a* and a magnetic material installation portion 110*a* in which the magnetic material 130*a* is to be installed may be provided on one side of a pin installation portion 150*a*. The magnetic material 130*a* is a component provided to maintain a state in which the pin 180*a* formed using a magnet is received in the first module 10*a*. For example, the magnetic material 130*a* may be a metallic plate including an iron component. Positions of the magnetic material 130*a* and the magnetic material installation portion 110*a* may correspond to those of the first magnet 130 and the first magnet installation portion 110 in the example embodiment described above. A magnitude of magnetic force of the pin 180*a* may be set to a magnitude at which the pin 180*a* may protrude outside the first module 10*a* by magnetic force of a second magnet of another module when a predetermined or greater magnitude of the magnetic force of the second magnet of the other module is applied to the pin 180*a*, and the pin 180*a* may be attracted by the magnetic material 130*a* and received in the first module 10*a* otherwise.

By the foregoing configuration, in a situation in which the first module 10*a* is not being coupled to another module, the pin 180*a* may be maintained in the second state in which the pin 180*a* is received in the first module 10*a*.

Similar to the first module 10*a*, a second module 20*a* may include a pin 280*a* formed using a magnet, a magnetic material 230*a*, and a magnetic material installation portion 210*a*.

In a process of coupling the first module 10*a* and the second module 20*a*, when a distance between the first module 10*a* and the second module 20*a* decreases to below a predetermined distance, magnetic force of a second magnet 140 of the first module 10*a* may be applied to a pin 280*a* of the second module 20*a*, and similarly magnetic force of the pin 280*a* of the second module 20*a* may also be applied to the second magnet 140 of the first module 10*a*. Thus, the pin 280*a* of the second module 20*a* may protrude to an outside and inserted into a pin receiver 160 of the first module 10*a*.

When the distance between the first module 10*a* and the second module 20*a* is greater than or equal to the predetermined distance, a magnitude of magnetic force between the second magnet 140 of the first module 10*a* and the pin 280*a* of the second module 20*a* may decrease to be less than a magnitude of magnetic force between the pin 280*a* and the magnetic material 230*a* of the second module 20*a*, and thus the pin 280*a* may be received in the second module 20*a*.

In this example, the pin 280*a* of the second module 20*a* and the second magnet 140 of the first module 10*a* may mutually attract each other directly, whereby the two modules 10*a* and 20*a* may be more firmly coupled to each other.

In the example embodiment, the pin 180*a*, the magnetic material 130*a*, and a second magnet of another module, or the second magnet 140, the pin 280*a* of the other module 20*a*, and the magnetic material 230*a* may maintain the pin 180*a* or the pin 280*a* of the other module 20*a* in the first state or the second state, and thus may also be referred to as a pin operator.

Hereinafter, a module assembly according to still another example embodiment will be described with reference to FIG. 7. However, the example embodiment of FIG. 7 differs from the example embodiment of FIG. 2 in terms of a disposition of pins, pin installation portions, and pin receivers. Thus, the example embodiment of FIG. 7 will be described based on such differences, and the same descriptions and reference numerals of FIG. 2 will be applied to the same components.

Figure 7:
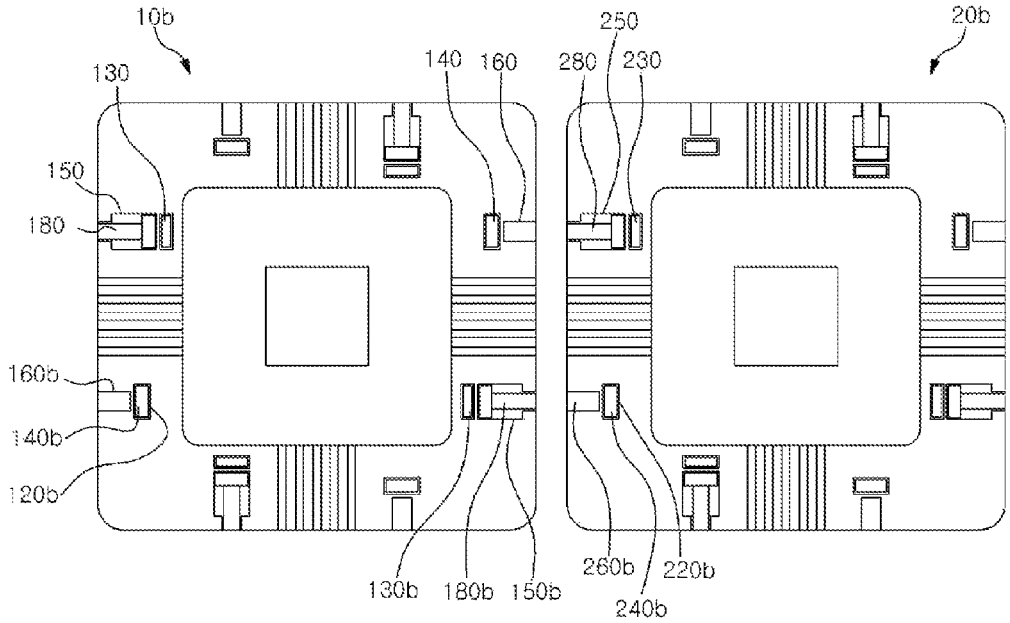
FIG. 7 illustrates a process of coupling a first module and a second module in a module assembly according to still another example embodiment.

FIG. 7 illustrates a process of coupling a first module and a second module in a module assembly according to still another example embodiment.

Referring to FIG. 7, a pin receiver 160, a pin installation portion 150*b*, and a pin 180*b* are disposed on one side of a first module 10*b* of a module assembly according to still another example embodiment. In detail, the pin receiver 160 and the pin 180*b* may be disposed separately on both sides with a terminal 107 as the center. Further, a first magnet 130*b* and a first magnet installation portion 110*b* may be installed on the same side on which a second magnet 140 and a second magnet installation portion 120 are installed.

Similarly, a pin and a pin receiver may be provided on each side of the first module 10*b*. In this example, the pin and the pin receiver may be disposed on each side in the same manner. In detail, in a case in which the pin receiver is disposed on the right side and the pin is disposed on the left side when viewed from a side, the pin and the pin receiver may be disposed on each of the other sides in the same manner.

Similar to the first module 10*b*, a second module 20*b* may include a pin receiver 260*b*, a second magnet 240*b*, and a second magnet installation portion 220*b* on a side on which a pin 280 and a pin installation portion 250 are installed.

A method of coupling the first module 10*b* and the second module 20*b* differs from that described with reference to FIG. 3 in terms of the disposition of the pins and the pin receivers only, and thus may be construed as substantially the same as that of FIG. 3.

In the example embodiment, a module may be coupled to another module irrespective of an orientation of the module. In detail, when vertical directions of the modules match, the two modules may be coupled to each other by disposing a predetermined side of one module proximate to the other module. The example embodiment may achieve greater effects when coupling a number of modules as shown in FIG. 5, and thus a user may assemble modules conveniently.

Hereinafter, a module assembly according to yet another example embodiment will be described with reference to FIGS. 8 through 10. However, the example embodiment of FIGS. 8 through 10 differs from the example embodiment of FIG. 2 in that modules are assembled on a plate. Thus, the example embodiment of FIGS. 8 through 10 will be described based on such differences, and the same descriptions and reference numerals of FIG. 2 will be applied to the same components.

Figure 8:
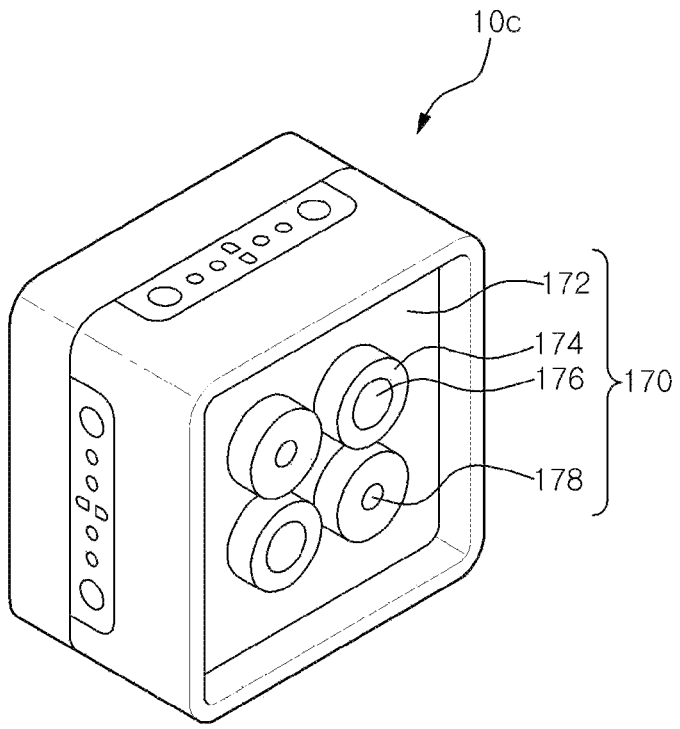
FIG. 8 is a perspective view illustrating a bottom of a module assembly according to yet another example embodiment.
Figure 9:
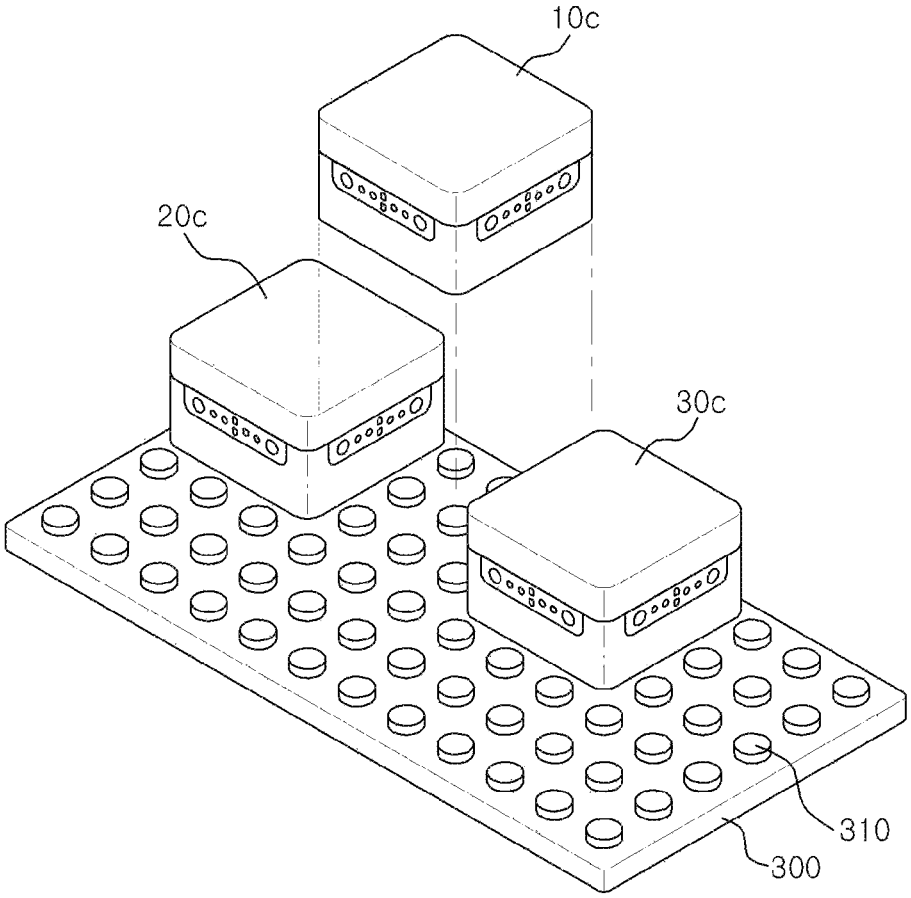
FIGS. 9 and 10 illustrate modules of FIG. 8 being assembled on a plate.
Figure 10:
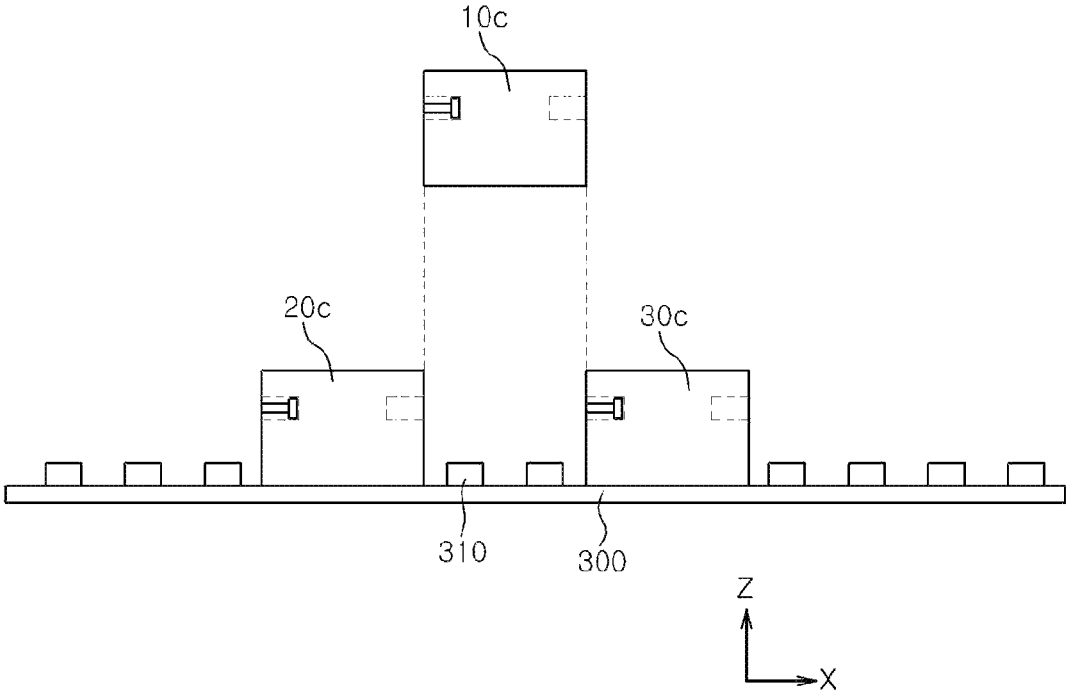

FIG. 8 is a perspective view illustrating a bottom of a module assembly according to yet another example embodiment, and FIGS. 9 and 10 illustrate modules of FIG. 8 being assembled on a plate.

Referring to FIGS. 8 through 10, a module assembly according to yet another example embodiment may be coupled to a plate 300 including a plurality of protrusions 310. A fit-coupling portion 170 may be formed on a bottom of a first module 10*c* to be coupled to the plate 300.

The protrusions 310 of the plate 300 may have cylindrical shapes extending at predetermined heights, and disposed at preset intervals in a matrix structure. The plate 300 may have the same shape as a block which is known as LEGO. The protrusions 310 may protrude in a direction perpendicular to the plate 300.

The fit-coupling portion 170 formed on the bottom of the first module 10*c* may include insertion recesses 172 into which one or more protrusions 310 may be inserted. The fit-coupling portion 170 may further include protrusions 174 in which bolt fastening holes 178 or magnets 176 may be provided to firmly fasten the first module 10*c*. The shapes and intervals of the protrusions 174 may correspond to those of the protrusions 310 of the plate 300 such that the protrusions 310 of the plate 300 may firmly fit in the insertion recesses 172 of the first module 10*c*. Here, the bolt fastening holes 178 and the magnets 176 may be used to additionally fasten the first module 10*c* to the plate 300. In addition, the bolt fastening holes 178 and the magnets 176 may be used to fasten the first module 10*c* to a predetermined location at which the first module 10*c* may be attached, for example, a wall.

Further, similar to the first module 10*c*, other modules 20*c* and 30*c* may each include a fit-coupling portion 170.

The modules 10*c*, 20*c*, and 30*c* formed as described above may need to be coupled to the plate 300 in a direction in which the protrusions 310 protrude, in detail, in a direction perpendicular to the plate 300. However, in the related arts, protrusions provided to couple modules protrude to an outside all the time. Although the modules may have configurations corresponding to the fit-coupling portion, the modules may not be sequentially coupled to the plate 300 since the protrusions may interfere in assembling. Thus, in the related arts, to assemble the modules on the plate 300, the modules need to be assembled first and the entire assembly needs to be coupled to the plate 300, or the modules need to be assembled by forcedly fitting the modules on the plate 300 using a predetermined level of external force.

However, in the module assembly according to the example embodiment, the first module 10*c* may be coupled to the plate 300 and the other modules 20*c* and 30*c* simultaneously while the other modules 20*c* and 30*c* are already assembled on the plate 300, as shown in FIGS. 9 and 10.

In detail, the first module 10*c* may fit in a space between the second module 20*c* and the third module 30*c* while being in surface contact with the second module 20*c* and the third module 30*c* simultaneously. In this example, a direction in which the first module 10*c* fits in is the same as a direction in which the protrusions 310 protrude, and a direction in which the first module 10*c* is to be coupled to the plate 300. When the first module 10*c* fits on the protrusions 310 of the plate 300, the first module 10*c* may be in surface contact with the second module 20*c* and the third module 30*c*, pins may protrude from one of the second module 20*c* and the third module 30*c* and be inserted into the first module 10*c*, and pins may protrude from the first module 10*c* and be inserted into the other of the second module 20*c* and the third module 30*c*. Thus, the first module 10*c* may be firmly fastened to the second module 20*c* and the third module 30*c*.

Hereinafter, a connector connected to an electronic device according to an example embodiment will be described with reference to FIGS. 11 and 12. The connector and the electronic device may each correspond to one module. The example embodiment will be described based on differences, and the same descriptions and reference numerals provided above will be applied to the same components.

Figure 11:
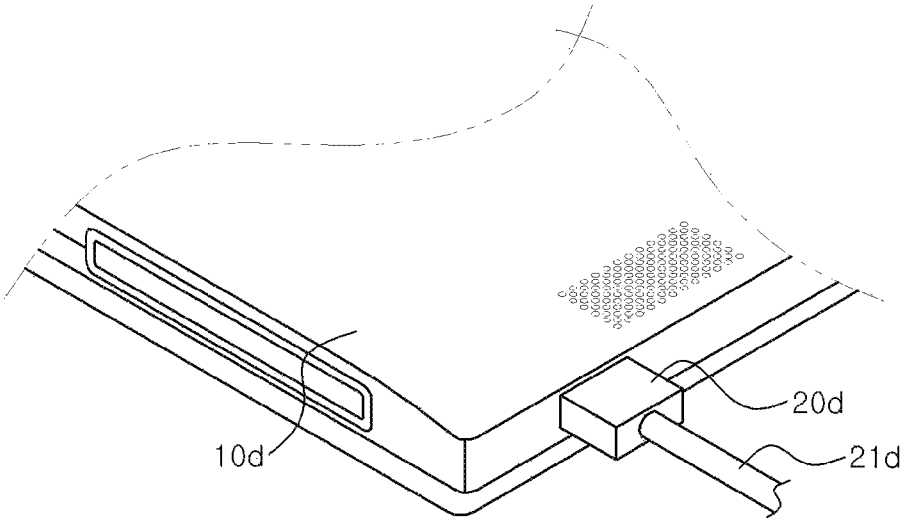
FIG. 11 illustrates a connector connected to an electronic device according to an example embodiment.
Figure 12:
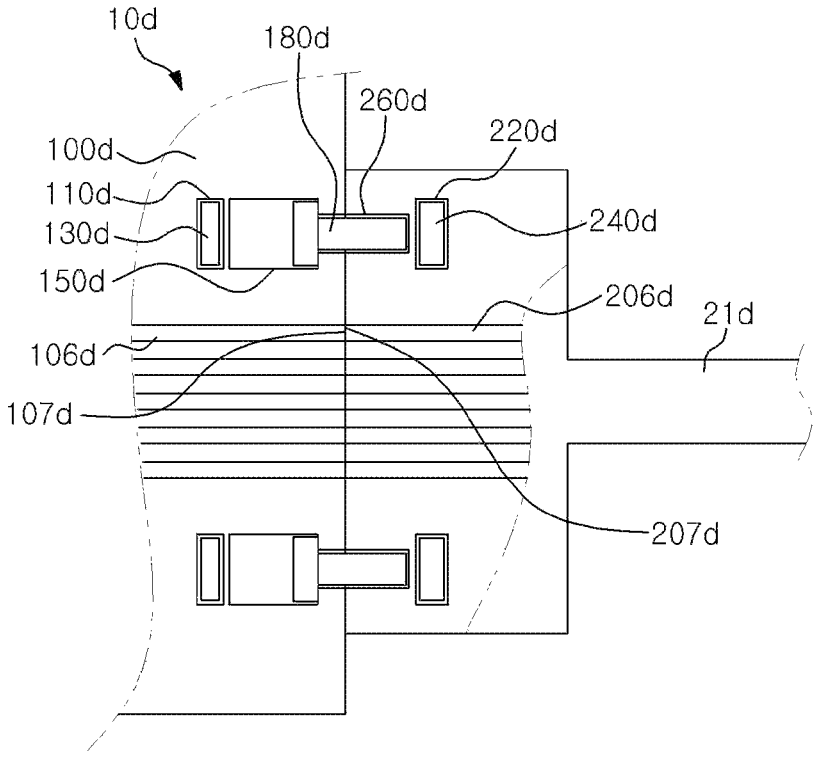
FIG. 12 is a top view illustrating inner structures of the connector and the electronic device of FIG. 11.

FIG. 11 illustrates a connector connected to an electronic device according to an example embodiment, and FIG. 12 is a top view illustrating inner structures of the connector and the electronic device of FIG. 11.

Referring to FIGS. 11 and 12, an electronic device 10*d* according to an example embodiment is a device that may operate independently, and be connected to an external device through a connector 20*d* to transmit and receive electric signals to and from the external device. The electronic device 10*d* may be, for example, a PC, a laptop computer, a smartphone, or a tablet PC. The connector 20*d* may include a cable 21*d* through which the electric signals may be transmitted and received.

The electronic device 10*d* and the connector 20*d* may be connected to each other in the manner substantially corresponding to the method of coupling the first module 10 and the second module 20 by means of the first magnets, the second magnet, the pins, the pin installation portions, and the pin receivers in the example embodiment described above.

In detail, the electronic device 10*d* may include a terminal 107*d* connected to a substrate (not shown) through a conducting wire 106*d* and exposed to an outside. Further, a pin 180*d*, a pin installation portion 150*d*, a first magnet 130*d* configured to maintain a state in which the pin 180*d* is received in the electronic device 10*d*, and a first magnet installation portion 110*d* configured to receive the first magnet 130*d* may be provided in a frame 100*d* of the electronic device 10*d*, in detail, on both sides with the terminal 107*d* as the center.

Relatively, the connector 20*d* may include a pin receiver 260*d* into which a pin 180*d* of the electronic device 10*d* is to be inserted, a second magnet 240*d* configured to apply magnetic force for the pin 180*d* to protrude from the electronic device 10*d*, and a second magnet installation portion 220*d* configured to receive the second magnet 240*d*. Further, a terminal 207*d* may be provided at an end portion of a conducting wire 206*d* extending through a cable 21*d*, and be in contact with the terminal 107*d* of the electronic device 10*d*.

A method and a process of coupling the electronic device 10*d* and the connector 20*d* configured as described above may be performed in substantially the same manner as described above.

In the example embodiment, similar to the related arts, an appearance of the connector 20*d* may be simplified by omitting bolts to be provided in an outer portion of the connector 20*d* to fasten the connector 20*d*, and thus the usability may improve. Further, coupling between the electronic device 10*d* and the connector 20*d* may be firmly maintained by the magnets 130*d* and 240*d* and the pin 180*d*.

In addition, in the example embodiment, an example in which the electronic device 10*d* includes the pin 180*d* and the connector 20*d* includes the pin receiver 260*d* is described. However, the electronic device 10*d* may include the pin receiver 260*d*, and the connector 20*d* may include the pin 180*d* and the pin installation portion 150*d*.

Hereinafter, an electronic device according to another example embodiment will be described with reference to FIG. 13. However, the example embodiment of FIG. 13 differs from the example embodiment of FIGS. 11 and 12 in that electromagnets are provided in the electronic device. Thus, the example embodiment of FIG. 13 will be described based on such differences, and the same descriptions and reference numerals of FIGS. 11 and 12 will be applied to the same components.

Figure 13:
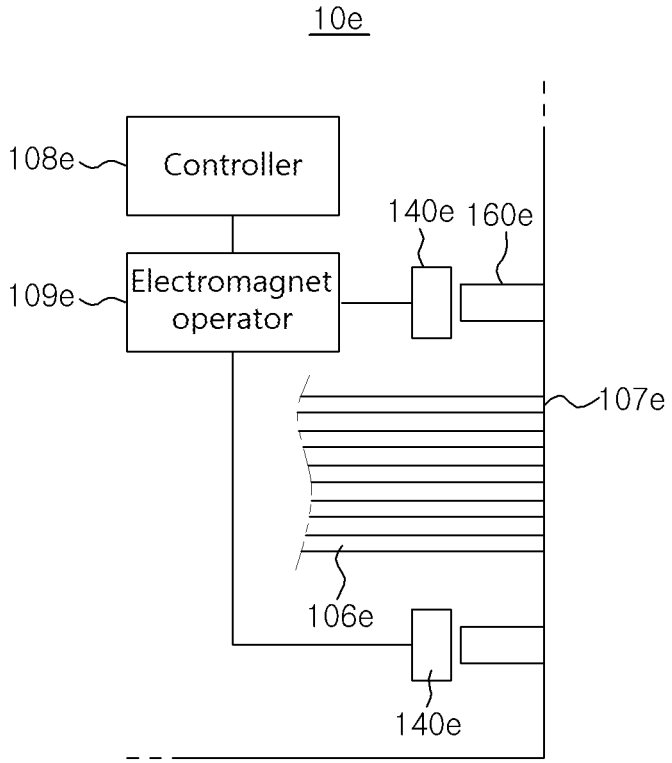
FIG. 13 is a top view briefly illustrating an inner structure of an electronic device according to another example embodiment.

FIG. 13 is a top view briefly illustrating an inner structure of an electronic device according to another example embodiment.

Referring to FIG. 13, a second magnet 140*e* of an electronic device 10*e* according to another example embodiment may be an electromagnet. The electronic device 10*e* may include a controller 108*e* configured to control an electromagnet operator 109*e* to selectively supply current to the second magnet 140*e* being the electromagnet. Further, in the example embodiment, the electronic device 10*e* may include a pin receiver 160*e*, and a connector may include a pin, a pin installation portion, and a first magnet.

In detail, the connector may be in contact with the electronic device 10*e*, and the terminal 107*e* may be connected to a terminal of the connector. When transfer of electric signals is sensed, the controller 108*e* may control the electromagnet operator 109*e* to magnetize the second magnet 140*e*. In doing so, the pin provided in the connector may be attracted toward the pin receiver 160*e*, and the connector and the electronic device 10*e* may be firmly coupled to each other.

Further, when a user disconnects the connector from the electronic device 10*e* and disconnection of the terminal 107*e* is sensed, the controller 108*e* may control the electromagnet operator 109*e* to demagnetize the second magnet 140*e*.

In addition, the user may use a user interface such as a display device, a touch screen, a touch pad, a keyboard, or a mouse to control the controller 108*e* to selectively magnetize or demagnetize the second magnet 140*e*. For example, in a case in which a separate monitor is used by being connected to the electronic device 10*e* through the connector, the user may turn off the current supplied to the second magnet 140*e* by inputting a predetermined instruction through the interface after using the monitor. In doing so, the user may easily disconnect the connector.

Meanwhile, in the example embodiment, in the connector and the electronic device, the components such as the pin, the pin installation portion, and the pin insertion portion may be omitted, and only the first magnet and the second magnet may be provided. In detail, the first magnet may be disposed at an end portion of the connector, and the second magnet

140*e* may be disposed adjacent to a side of the electronic device 10*e*. Accordingly, the second magnet 140*e* of the electronic device 10*e* may selectively attract the first magnet of the connector, thereby maintaining a coupling state between the connector and the electronic device 10*e*.

The electronic device 10*e* according to the example embodiment may supply strong current to the second magnet 140*e* to increase a magnitude of magnetic force, whereby the connector may be more firmly fastened to the electronic device 10*e*.

The module assembly, the connector, and the electronic device according to example embodiments are described in detail above. However, the example embodiments are not limited thereto, and should be construed broadly within its spirit and scope disclosed herein. It will be apparent to those skilled in the art that the example embodiments can be combined and/or replaced to achieve alternative example embodiments not explicitly described herein, without departing from the spirit or scope of the present disclosure. In addition, various alterations and modifications may be made to the example embodiments disclosed herein, and should be construed as being covered within the scope of the following claims.

What is claimed is:

1. A module assembly comprising:

a first module comprising a pin configured to selectively protrude from a side of the first module, a pin installation portion in which the pin is installed to be movable, and a first magnet configured to attract the pin into the pin installation portion; and a second module to be coupled to the first module, the second module comprising a pin receiver configured to receive the pin when the pin protrudes from the first module, and a second magnet configured to attract the pin into the pin receiver, wherein the second magnet is configured to apply, to the pin, a greater magnitude of magnetic force than the magnitude of magnetic force applied by the first magnet in a case in which a distance between the first module and the second module is less than a preset distance.

2. The module assembly of claim 1, wherein the first module and the second module each comprise a terminal configured to transfer at least one of electric energy, electric signals, and data, and the terminal of the first module is in contact with the terminal of the second module when the first module is coupled to the second module.

3. The module assembly of claim 1, wherein the pin comprises a head and a projection protruding from the head, and the pin installation portion comprises a head guide configured to provide a space in which the head is movable and to guide a movement of the head, a projection guide configured to provide a space in which the projection is movable and to guide a movement of the projection, and a stopper provided between the head guide and the projection guide to prevent the head from being separated toward an outside of the first module.

4. The module assembly of claim 1, wherein the second module further comprises a pin, a pin installation portion, and a first magnet on a side of the second module where the pin receiver is formed, and the first module further comprises a pin receiver into which the pin of the second module is to be inserted, and a second magnet on a side of the first module where the pin of the first module is formed.

5. The module assembly of claim 1, wherein the first module further comprises a pin, a pin installation portion, and a first magnet, or further comprises a pin receiver and a second magnet on another side of the first module for coupling with another module, and the second module further comprises a pin, a pin installation portion, and a second magnet on another side of the second module for coupling with another module.

6. The module assembly of claim 1, wherein the first module is one of an electronic device and a connector being connected to an external device via a cable, and the second module is the other of the electronic device and the connector.

7. A module assembly comprising a plurality of modules, wherein the modules each comprise:

a housing having a plurality of sides;

at least one pin provided on a side of the housing, and configured to be in a first state in which the pin protrudes from the housing or a second state in which the pin is received in the housing; and at least one pin receiver provided on a side of the housing, and configured to receive a pin protruding from another module, wherein one of the modules is to be surface-to-surface coupled to another of the modules, wherein, when the one module is surface-to-surface coupled to said another module, a pin of the one module switches from the second state to the first state to be inserted into a pin receiver of said another module, wherein the one module and said another module each comprise a pin operator configured to switch the pin between the first state and the second state, and wherein the pin operator comprises:

a first magnet provided in the one module and configured to attract the pin into the one module; and a second magnet provided in said another module and configured to attract the pin toward the pin receiver of said another module.

8. The module assembly of claim 7, wherein, when the one module is decoupled from said another module, the pin switches from the first state to the second state.

9. The module assembly of claim 7, further comprising:

a plate comprising a plurality of protrusions to which the modules are to be coupled, wherein a fit-coupling portion to be coupled to one or more of the projections is formed on a bottom of each of the modules.

10. The module assembly of claim 9, wherein the pin is configured to protrude in a direction perpendicular to a direction in which the modules fit on the plate.

11. The module assembly of claim 7, wherein the housing comprises:

a frame configured to form an appearance and an inner structure of the housing;

a substrate disposed on an inner side of the frame;

a terminal provided on a side of the frame and configured to transfer at least one of electric energy, electric signals, and data; and a conducting wire configured to electrically connect the substrate and the terminal.

12. The module assembly of claim 11, wherein a processor is provided on the substrate, and the modules each are configured to operate independently.

13. The module assembly of claim 11, wherein the housing is formed in the shape of a rectangular parallelepiped, and the terminal is formed on each side of the housing.

14. The module assembly of claim 11, wherein a pair of pins, a pair of pin receivers, or both the pin and the pin receiver are disposed on each side of the housing with the terminal being disposed at a center of the housing.

* * * * *